United States Patent [19]

Widdowson

[11] 4,342,421

[45] Aug. 3, 1982

[54] THERMOSTATIC EXPANSION VALVE FOR A REFRIGERATION SYSTEM

[75] Inventor: Richard E. Widdowson, Dayton, Ohio

[73] Assignee: General Motors Corporation, Detroit, Mich.

[21] Appl. No.: 237,249

[22] Filed: Feb. 23, 1981

[51] Int. Cl.[3] ..... F25C 41/04

[52] U.S. Cl. ..... 236/92 B; 62/225

[58] Field of Search ..... 236/92 B; 62/225

[56] References Cited

U.S. PATENT DOCUMENTS

| | | | |
|---|---|---|---|
| 2,663,502 | 12/1953 | Dillman et al. | 236/92 B |
| 2,755,025 | 7/1956 | Boles | 236/92 B |
| 2,786,336 | 3/1957 | Lange | 236/92 B X |
| 3,054,273 | 9/1962 | McGrath | 236/92 B X |
| 3,402,566 | 9/1968 | Leimbach | 62/225 X |
| 3,414,014 | 12/1968 | Merchant et al. | 62/225 X |
| 3,564,865 | 2/1971 | Spencer et al. | 62/197 |
| 3,738,573 | 6/1973 | Eschbaugh et al. | 236/92 B |

FOREIGN PATENT DOCUMENTS

| | | | |
|---|---|---|---|
| 821760 | 10/1959 | United Kingdom | 236/92 B |

*Primary Examiner*—William E. Tapolcai, Jr.
*Attorney, Agent, or Firm*—R. L. Phillips

[57] ABSTRACT

A thermostatic expansion valve is disclosed for a refrigerant system that modulates the fluid flow with a capsulated refrigerant pressure that is temperature regulated through direct heat conduction from the evaporator outlet and further controls the flow with evaporator inlet pressure modulated by a venturi effect.

2 Claims, 2 Drawing Figures

THERMOSTATIC EXPANSION VALVE FOR A REFRIGERATION SYSTEM

This invention relates to thermostatic expansion valves for refrigerant systems and more particularly to a line-mounted thermostatic expansion valve that is adapted to be connected in the high pressure liquid line between the condenser and evaporator and on the suction line at the evaporator outlet.

In refrigerant systems such as those employed in automotive air conditioners, it is well-known that fixed restrictions and other non-compensating expansion devices in the high presure liquid refrigerant line between the condenser and evaporator can only compromise in system performance when operating conditions change such as the result of the compressor being driven at a variable speed by the engine as well as with changes in ambient conditions. For example, the refrigerant flow should maintain a relative constant evaporator or corresponding saturation pressure just sufficient to overcome the heat load in the evaporator. This will provide full utilization of the evaporator if sufficient compressor capacity remains available. However, if there is insufficient compressor capacity as may occur at engine idle and high ambient conditions, the evaporator pressure will not then correspond to the saturation temperature and can only be below optimum for compressor capacity. Moreover, there may occur higher refrigerant flow than necessary at increased engine speed and reduced loads. It is known that a thermostatic expansion valve sensitive to pressure as well as temperature can be employed to maintain the evaporator fully active under all load conditions. This is disclosed, for example, in U.S. Pat. No. 3,564,865 assigned to the assignee of this invention. However, such added pressure sensing has required an extended communication circuit as the pressure to be sensed is at the evaporator outlet whereas the thermostatic expansion valve is at the evaporator inlet.

The thermostatic expansion valve according to the present invention is pressure as well as temperature sensitive without requiring an extended communication circuit to sense pressure at the evaporator outlet and operates to maintain a fully active evaporator under all load conditions. In the preferred embodiment of the present invention, the thermostatic expansion valve has a valve body that is adapted for connection in the condenser-evaporator high pressure liquid line and has a valve port having an upstream side for receiving refrigerant from the condenser and downstream side for delivering the refrigerant to the evaporator. In addition, a bypass passage is connected in parallel with valve port to provide a continuously open but restricted flow passage between the upstream and downstream sides. A valve element is provided which is movable to open and close the valve port and a spring is provided for biasing the valve element to its closed position. A temperature responsive valve biasing arrangement is provided for biasing the valve element towards it open position with a biasing force that increases with increasing temperature. A pressure responsive valve biasing arrangement is additionally provided for reducing the valve opening bias in response to increasing pressure and includes a pressure signal passage that connects with the downstream side so as to transmit a pressure that is proportional to the pressure on the downstream side but decreases upon a substantial increase in fluid velocity through the valve port by operation of a designed in venturi effect which approximates the pressure drop across the evaporator at such high flow. Moreover, a connector heat conduction arrangement is provided for connecting the temperature responsive valve biasing arrangement in direct heat conducting relationship with the evaporator-compressor line. With such arrangements and connections, the valve element is normally urged to its closed position by the spring bias and is urged toward its open position and provides regulated flow to the evaporator to maintain the latter substantially fully active under all load conditions by the temperature responsive bias providing a valve opening force that increases with increasing temperature of refrigerant from the evaporator and by the pressure responsive bias decreasing the valve opening force with increasing pressure of the refrigerant delivered to the evaporator except when there occurs a substantial reduction in flow thereto by signaling of the pressure signal passage. Thus, the thermostatic expansion valve of the present invention provides regulated refrigerant flow to the evaporator according to the balance of the evaporator inlet pressure, the condenser outlet or high-side liquid inlet pressure and the spring force. However, when a sufficient flow of refrigerant occurs to the evaprator, the valve is then sensitive by venturi effect to such flow velocity to alter normal valve modulation and permit the evaporator outlet temperature bias to condition the valve for a more open position, thus eliminating the need for equalizing the valve at the evaporator outlet. On the other hand, when the lesser flow occurs through the valve, such as during an idle or low compressor speed, the normal valve regulating bias using evaporator outlet temperature and inlet pressure is permitted to operate with the result being that the valve is thus capable of maintaining a substantially full active evaporator under all load conditions.

These and other objects, advantages and features of the present invention will be more apparent from the following description and drawing in which.

Figure 1:
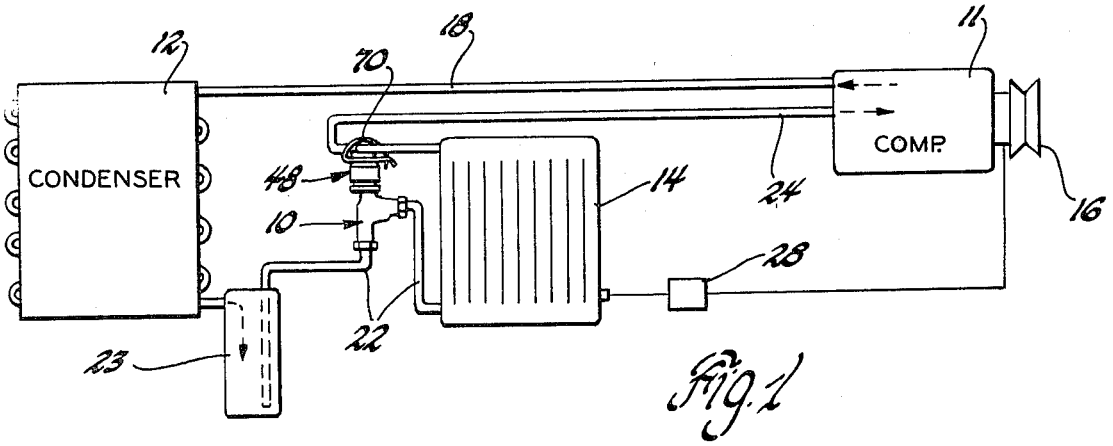
FIG. 1 is a diagramatic view of an automotive air conditioning system having incorporated therein the preferred embodiment of the thermostatic expansion valve according to the present invention.

Referring to FIG. 1, there is shown the preferred embodiment of the thermostatic expansion valve 10 according to the present invention installed in an automotive air conditioning system; such system typically basically comprising a compressor 11, condenser 12 and an evaporator 14. The compressor 11 is driven through an electromagnetic clutch 16 by the vehicle's engine, not shown, and delivers refrigerant at high pressure and in vapor form via a discharge line 18 to the condenser 12 which is located in the air intake stream to the vehicle's engine compartment. The refrigerant exits the condenser 12 at high pressure but now in liquid form to a high pressure liquid compressor-evaporator line 22 in which the thermostatic expansion valve 10 is installed upstream of the connection of this line to the evaporator 14, there being further provided in the line a receiver-dehydrator 23 upstream of the expansion valve. Air is drawn through the evaporator 14 and blown at a cooled temperature into the passenger compartment with the refrigerant exiting the evaporator 14 then being at low pressure and in vapor form and returned by a suction line 24 to the compressor 11. The air conditioning system further includes a clutch switch 28 which senses evaporator metal and/or air temperature or refrigerant pressure to control engagement of the clutch 16. The system thus far described apart from the details of the thermostatic expansion valve 10 is conventional and thus further description thereof apart from the interaction of this valve is not believed necessary.

Figure 2:
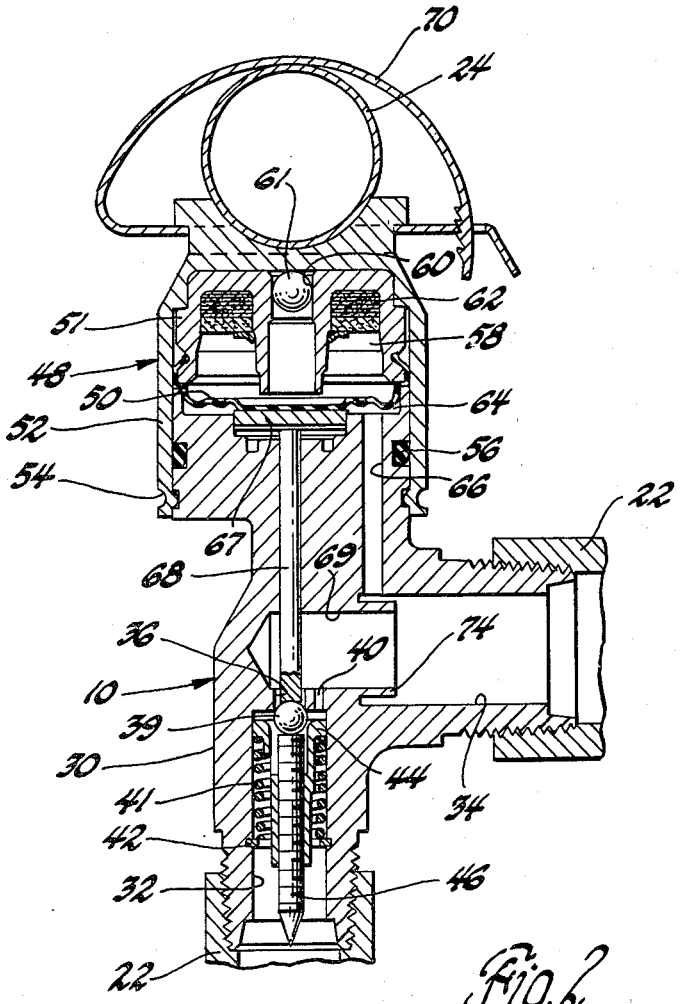
FIG. 2 is an enlarged sectional view of the thermostatic expansion valve in FIG. 1.

Describing now the details of the thermostatic expansion valve 10, its assembly comprises as shown in FIG. 2 a valve body 30 having an externally threaded inlet 32 and outlet 34 which are at right angles to each other and are connected in the condenser-evaporator line 22 close to the evaporator 14. In the valve body 30, there is provided a valve port 36 having an upstream side open to the inlet 32 and a downstream side open to the outlet 34. A movable valve element in the form of a ball 39 is movable to open and close the valve port 36 on the upstream side thereof while a restrictive bypass port 40 in parallel with the valve port 36 provides continuous communication between the upstream and downstream sides. Closing movement of the ball valve 39 is forced by the high-side liquid inlet pressure and a helical coil spring 41 which seats at one end on a snap ring 42 mounted in a groove in the inlet 32 and at its other end engages a movable valve seat 44 slidably mounted in the inlet. A spring load adjusment screw 46 is threaded to the movable valve seat 44 and acts directly on the ball valve 39, the movable valve seat 44 being ported so as to permit flow therethrough to the valve port 36.

Temperature responsive valve biasing means including a diaphragm capsule assembly 48 are provided for biasing the ball valve 39 toward its open position with a biasing force that increases in response to increasing evaporator outlet temperature. The diaphragm capsule assembly 48 comprises a diaphragm 50 which is sealingly clamped about its perimeter in the top of the valve body 30 by a cap 51, the cap being retained thereon by a cover 52 which secured to the valve body by stakes 54 and is sealed thereto by an O-ring seal 56. The diaphragm 50 cooperates with the interior of the cap 51 to form a chamber 58 which is charged with refrigerant through an opening 60 in the cap that is then sealed by a press-fitted ball 61, there being provided a desiccant such as charcoal 62 in the sealed chamber 58 to absorb and limit the refrigerant pressure. The other side of the diaphragm 50 cooperates with the valve body 30 to form a pressure chamber 64 which is connected by a pressure signal passage 66 to outlet 34 as described in more detail later. The diaphragm 50 transmits an opening force to the movable ball valve 39 through a disk 67 which is centrally fixed to the diaphragm 50 and operates on one end of a rod 68. The rod 68 is slidably mounted in the valve body 30 and extends across a reduced portion 69 of the outlet 34 and engages at its opposite end through the valve port 36 with the ball valve 39.

The capsuled refrigerant pressure in chamber 58 is regulated by the temperature of the refrigerant within the suction line 24 at the outlet from the evaporator 14 and this is accomplished through direct heat conduction by clamping the valve cover 52 of the thermostatic expansion valve in direct metal-to-metal contact with the suction line 24 at the evaporator outlet by clamp means such as the spring steel clamp 70 shown. The valve cover 52 and cap 51 which is in extensive contact therewith act as a heat conducting medium between the refrigerant in the suction line 24 at the evaporator outlet and the capsuled refrigerant in the sealed valve chamber 58 so that the diaphragm capsule assembly 50 is sensitive to the evaporator outlet temperature. Moreover, the diaphragm capsule assembly 50 is also made sensitive to a pressure signal that is modified by venturi effect so as to be comparable with that at the evaporator outlet. This is accomplished within the valve outlet 34 by a step 74 which is formed and trepanned to a depth where the signal passage 66 is thus exposed to the passing refrigerant where the valve outlet 34 joins with the reduced portion 69 extending from the downstream side of the valve port 36 connected past the step to the outlet 34. As a result, the pressure within the trepanned cut and thus transmitted by the pressure signal passage 66 will be reduced a substantial amount by venturi effect above a certain flow rate through the valve outlet 34 and this is utilized to assimilate pressure drop across the evaporator to equalize the signal pressure to the diaphragm valve chamber 64 with the evaporator outlet pressure as will be described in more detail later.

Describing now the operation of the mounted thermostatic expansion valve 10 in the system, the ball valve 39 is normally urged to its closed position by the high-side liquid inlet pressure and the spring 41 and is urged toward its open position to provide regulated flow to the evaporator by the diaphragm 50 providing a valve opening force that increases with increasing temperature of refrigerant at the evaporator outlet while evaporator inlet pressure transmitted by the signal passage 66 to the diaphragm 50 acts to reduce the valve opening force and thus the flow rate. Below a certain refrigerant flow, the pressure drop across the evaporator is negligible (less than for example 3–5 psi) and a low signal pressure (for example 28–30 psi) is transmitted to the diaphragm 50 tending to open the valve. This is according to desired demand. However, when the refrigerant flow reaches a level where a substantial pressure drop (greater than 3–5 psi) occurs across the evaporator the evaporator inlet pressure is also high (for example 38–40 psi). This high evaporator inlet pressure if sensed by the diaphragm 50 would tend to close the valve which is contrary to desired demand. However, this is avoided by the signal passage 66 with its trepanned venturi connection with the valve outlet 34 (evaporator inlet). According to the present invention, the signal passage connection is formed such that when there occurs such high flow of refrigerant past the stepped area 74, the pressure within the trepanned cut is then substantially reduced by venturi effect to a pressure simulating evaporator outlet pressure. With such reduced refrigerant pressure to the chamber 64, this causes the diaphragm 50 and thus the ball valve 39 to move toward a more open position thereby eliminating the necessity for pressure equalizing the expansion valve at the evaporator outlet with a separate external line. On the other hand, when a lesser flow occurs across the stepped area 74 such as during idle or low-speed operation, the venturi effect is negligent and full evaporator inlet pressure is transmitted by the signal passage 66 to the diaphragm 50. In this way, the thermostatic expansion valve operates to maintain a fully active evaporator under all load conditions.

The above described preferred embodiment is illustrative of the invention which may be modified within the scope of the appended claims.

The embodiments of the invention in which an exclusive property or privilege is claimed are defined as follows:

1. A thermostatic expansion valve for a refrigerant system having a condenser-evaporator line connecting a condenser at its outlet to an evaporator at its inlet and a suction line connecting the evaporator at its outlet to a compressor at its inlet, said valve having an inlet and outlet adapted for connection in the condenser-evaporator line and comprising a valve port having an upstream side open to said valve inlet for receiving refrigerant from the condenser and a downstream side open to said valve outlet for delivering the refrigerant to the evaporator, a valve element movable between open and closed positions to open and close said valve port, said valve element arranged on said upstream side so as to be urged towards its closed position by refrigerant pressure at said valve inlet, spring means for biasing said valve element to its closed position, temperature responsive valve biasing means for biasing said valve element toward its open position with a biasing force that increases in response to increasing temperature, pressure responsive valve biasing means for reducing said biasing force of said temperature responsive valve biasing means in response to increasing pressure, pressure signal passage means including a trepanned venturi connected with said downstream side for connecting said downstream side to said pressure responsive valve biasing means so as to transmit thereto a pressure that is proportional to the pressure on said downstream side but decreases upon a substantial increase in fluid flow through said valve port, and heat conduction means for directly connecting said temperature responsive pressure means in heat conducting direct body contact relationship with the suction line whereby said valve element is normally urged to its closed position by said spring means and refrigerant pressure at said valve inlet and is urged towards its open position and provides regulated flow to the evaporator to maintain the latter substantially fully active under all load conditions by said temperature responsive valve biasing means providing an opening valve force that increases with increasing temperature of refrigerant from the evaporator and decreases by operation of said pressure responsive valve biasing means with increasing pressure of the refrigerant delivered to the evaporator except when there occurs a substantial reduction in flow thereto by signaling of said pressure signal passage means.

2. A thermostatic expansion valve for a refrigerant system having a condenser-evaporator line connecting a condenser at its outlet to an evaporator at its inlet and a suction line connecting the evaporator at its outlet to a compressor at its inlet, said valve having an inlet and outlet adapted for connection in the condenser-evaporator line and comprising a valve port having an upstream side open to said valve inlet for receiving refrigerant from the condenser and a downstream side open to said valve outlet for delivering the refrigerant to the evaporator, a valve element movable between open and closed positions to open and close said valve port, said valve element arranged on said upstream side so as to be urged towards its closed position by refrigerant pressure at said valve inlet, spring means for biasing said valve element to its closed position, temperature responsive valve biasing means including a capsule of refrigerant encapsulated in-part by a diaphragm for biasing said valve element toward its open position with a biasing force that increases in response to increasing temperature of the encapsulated refrigerant, pressure responsive valve biasing means including a pressure chamber formed in-part by said diaphragm for reducing said biasing force of said temperature responsive valve biasing means in response to increasing pressure on said diaphragm, pressure signal passage means including a venturi connection for connecting said downstream side to said pressure chamber of said pressure responsive valve biasing means so as to transmit to said diaphragm a pressure that is proportional to the pressure on said downstream side but decreases by venturi effect upon a substantial increase in fluid flow through said valve port, and heat conduction means for directly connecting said capsule of refrigerant in heat conducting relationship with the suction line whereby said valve element is normally urged to its closed position by said spring means and refrigerant pressure at said valve inlet and is urged towards its open position and provides regulated flow to the evaporator to maintain the latter substantially fully active under all load conditions by said temperature responsive valve biasing means providing an opening valve force that increases with increasing temperature or refrigerant from the evaporator and decreases by operation of said pressure responsive valve biasing means with increasing pressure of the refrigerant delivered to the evaporator except when there occurs a substantial reduction in flow thereto by signaling of said pressure signal passage means.

* * * * *